United States Patent [19]

Wagar

[11] 4,305,520

[45] Dec. 15, 1981

[54] RECORD STORAGE APPARATUS

[76] Inventor: Robert L. Wagar, 8189 W. Carpenter Rd., Flushing, Mich. 48433

[21] Appl. No.: 90,515

[22] Filed: Nov. 2, 1979

[51] Int. Cl.[3] ..... B42F 15/02

[52] U.S. Cl. ..... 210/22.1

[58] Field of Search ..... 220/22, 22.1, 22.2, 220/22.3, 22.4, 22.5, 22.6, 22.7; 312/184

[56] References Cited

U.S. PATENT DOCUMENTS

| | | | |
|---|---|---|---|
| 580,899 | 4/1897 | Roberts . | |
| 1,194,536 | 8/1916 | Oliver | 312/184 |
| 1,684,842 | 9/1928 | Morse . | |
| 1,712,168 | 5/1929 | Rand . | |
| 2,169,562 | 8/1939 | Lombardini . | |
| 3,524,688 | 8/1970 | Dean | 312/184 |
| 3,917,105 | 11/1975 | Lambert . | |

FOREIGN PATENT DOCUMENTS

| | | | |
|---|---|---|---|
| 1397129 | 6/1975 | United Kingdom | 312/184 |

*Primary Examiner*—George E. Lowrance
*Attorney, Agent, or Firm*—Arnold S. Weintraub

[57] ABSTRACT

A storage apparatus for removably receiving planar members, such as business records. The storage apparatus comprises a storage container having front and rear wall portions and a pair of spaced rods extending horizontally therebetween. A file envelope is adapted to be removably inserted into the storage container. The file envelope is formed with front and rear upstanding walls, each including an aperture located along the side edge. The apertures engage the pair of spaced rods in the storage container to enable the file envelope to be placed on and slidingly supported by the rods. Removable securing members are placed along the side edges of the file envelope on the rods in the storage container.

7 Claims, 3 Drawing Figures

RECORD STORAGE APPARATUS

BACKGROUND OF THE INVENTION

1. Field of the Invention:

This invention relates, in general, to record keeping and, more specifically, to storage apparatus for storing a group of records.

2. Description of the Prior Art

In the modern business world, the efficient storage of business forms, such as letters and records, is essential to efficient organization and operation of the business. In achieving such efficiency, the business records must be stored in as compact a manner as possible and yet, at the same time, allow for easy retrieval during daily business operations. This is especially critical in storing small rectangular cards, containing idicia of computer programs or the so-called magnetic cards utilized by modern word processing equipment. Such types of business records must be retained in groups, with the cards in each group maintained in a predetermined order.

It is common to store these types of business records in standard file drawers formed with front, rear, side and bottom portions and an open top. The cards are arranged in the desired groups and order and disposed in a vertical upstanding manner within the drawer. However, problems of quick identification and retrieval of a desired group of cards is difficult in standard file drawer arrangements, as well as maintaining the cards in a vertical orientation to prevent damage to the cards and to permit more compact storage.

A variety of filing apparatus, including file drawers and file dividers or envelopes, are well-known to the skilled artisan. Such apparatus includes a bill file disclosed in U.S. Pat. No. 193,296 wherein a plurality of dividers are positioned within a file drawer. The dividers having notches in the sides thereof which engage a pair of strips disposed along the horizontal sides of the drawer. Papers or other records are placed between the dividers if desired, with the dividers being slidingly moveable along the strip so as to accommodate different numbers of papers or records therebetween.

It is also known to provide dividers which include apertures at the top end thereof which engage horizontally extending strips in the side of a file drawer to hold the file in a vertical upright position and to permit sliding movement of the file dividers within the drawer, as shown in U.S. Pat. No. 1,712,168.

However, such file or record keeping apparatus are difficult to use with the small rectangular cards. In the first instance, no means are provided for maintaining the cards securely together in a predetermined order between the dividers so as to permit easy and quick retrieval of an entire group of cards or records. In the latter apparatus, the horizontal rods must be removed from the drawer to permit removal of the file dividers from the drawer for rearrangement of the file system.

Thus, it would be desirable to provide a storage apparatus for business records which overcomes the problems associated with prior art filing apparatus in storing business records or documents. It would also be desirable to provide a file storage apparatus which maintains the business records together in a group and in predetermined order within each group so as to facilitate easy removal of a group of records from the file drawer. It would also be desirable to provide a storage apparatus which allows quick and easy removal of the file divider from the file drawer. Finally, it would be desirable to provide a storage apparatus which protects the business records contained therein from damage and which maintains the records in a vertical position within the storage apparatus.

SUMMARY OF THE INVENTION

There is disclosed herein a new and improved storage apparatus adapted to receive planar members such as business records. The storage apparatus comprises a storage container having front and rear portions and a pair of spaced rods extending substantially horizontally therebetween. A file envelope is formed with front and rear upstanding walls each having top, bottom and opposed side portions. Preferably, the side and bottom portions of the front and rear walls of the file envelope are joined together to form a continuous enclosure having an open top to receive a plurality of planar members, such as rectangular cards or records therein. The file envelope includes a pair of apertures located along the side portions thereof. The apertures have an open end which engages the pair of spaced rods in the storage container so as to enable the file envelope to be placed on and supported by the rods for sliding movement therealong. The file envelope of this invention further includes means for removably securing the file envelope on the rods. The securing means comprises a substantially U-shaped member having first and second depending legs. The securing member is disposed over the file envelope and placed adjacent the side portion of the file envelope between the rod disposed in the aperture and the side edge of the envelope so as to secure the envelope on the rods and yet permit sliding movement of the file envelope therealong.

The storage apparatus of this invention is ideally suited for use with standard forms of business records or documents such as small rectangular computer cards or the so-called magnetic cards utilized in modern word processing equipment, as well as other forms of business records, such as magnetic floppy discs and papers. The storage apparatus maintains a predetermined group of records in the desired order therein as well as maintaining the records in a vertical orientation so as to protect the records from damage and to permit more compact storage. Also, the file envelope may be easily removed from the storage container so as to facilitate reorganization of the record system. In this manner, the problems with prior art filing apparatus which require the removal of the guide rods from the drawer to allow the file envelope or divider to be removed therefrom are eliminated. Further, since the entire file envelope can be removed from the storage container, the possibility of losing several of the rectangular cards in a group is minimized.

BRIEF DESCRIPTION OF THE DRAWING

The various features, advantages and other uses of this invention will become more apparent by referring to the following detailed description of the drawing in which.

DESCRIPTION OF THE PREFERRED EMBODIMENTS

Figure 1:
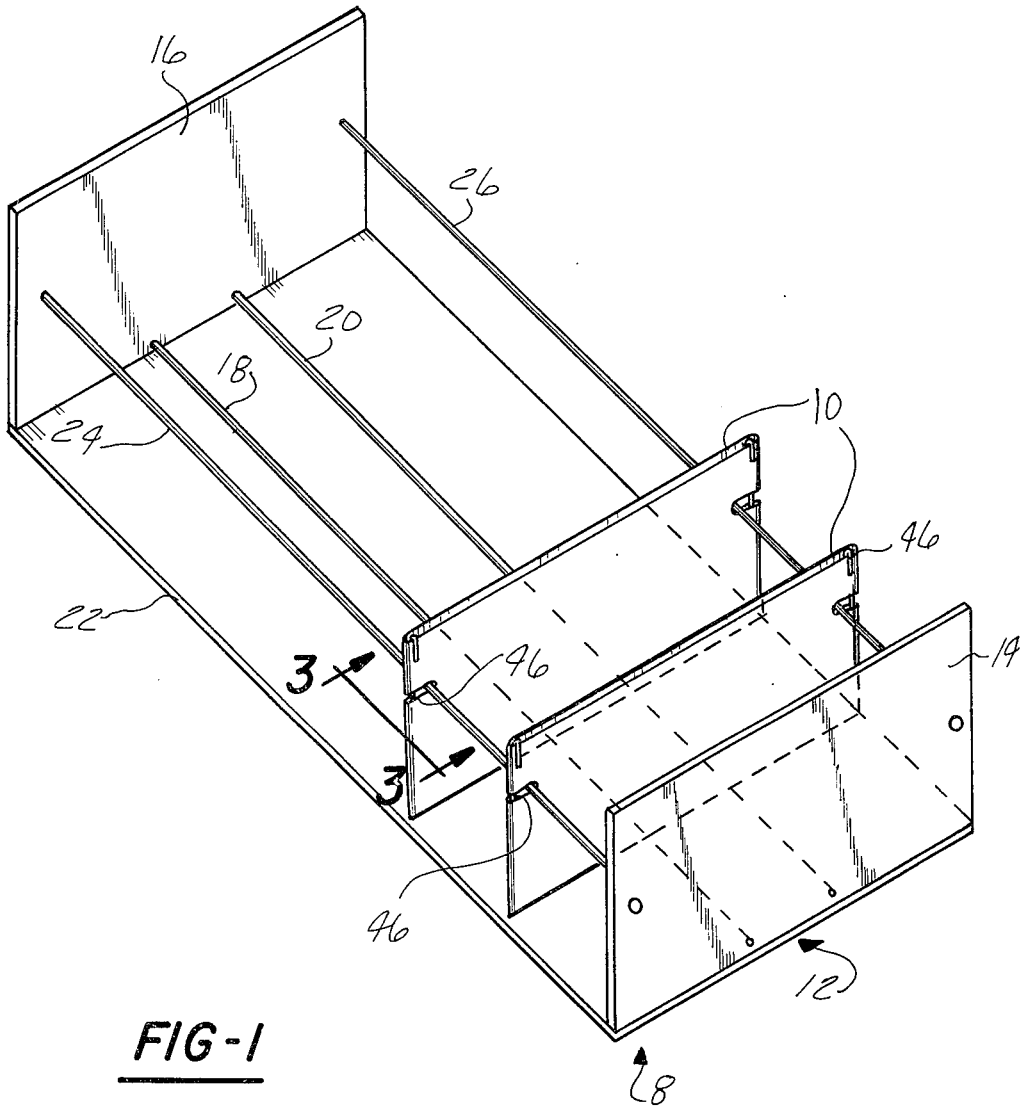
FIG. 1 is a perspective view of a storage apparatus constructed according to the teachings of this invention.
Figure 2:
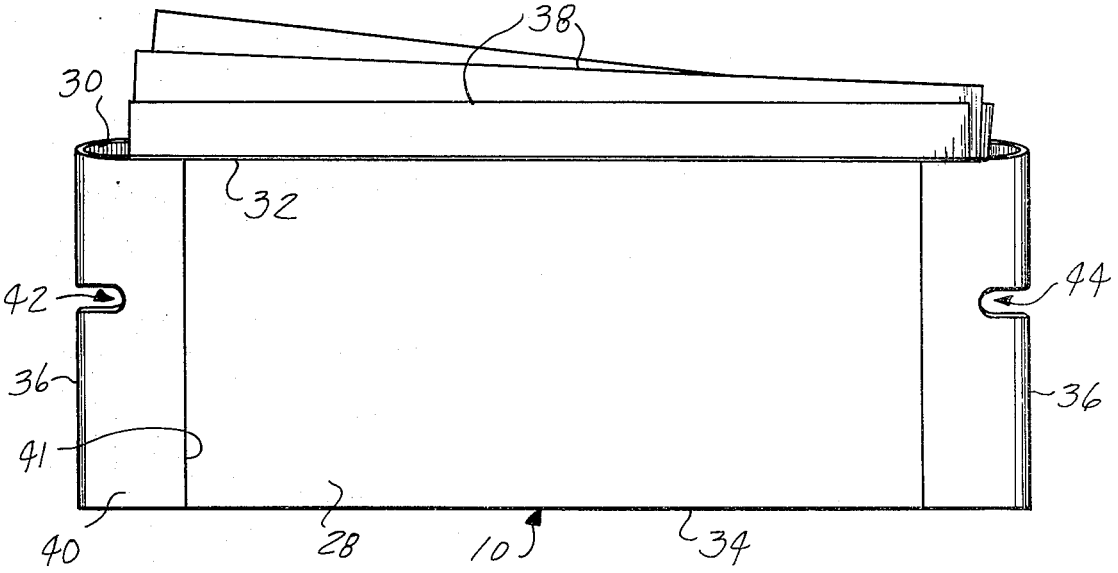
FIG. 2 is a perspective view of a file envelope of this invention.

Referring now to the drawing and, in particular, to FIGS. 1 and 2, there is shown a storage apparatus 8 comprising a file envelope or divider 10 and a storage container 12.

The storage container 12 is an enclosure formed with spaced front and rear portions 14 and 16, respectively. The front and rear walls 14 and 16 are spaced apart and supported by a bottom portion 22. Side walls, not shown, may also be provided if desired, to form a continuous enclosure around the business records. Thus, the storage container 12 forms an enclosure having an open top.

The storage container 12 may be a rack which can be portable so as to be easily placed on top of a desk or table or moved around to where it is needed within an orifice. It may also be utilized to provide a convenient method for transporting business records from place to place. In this application, a suitable handle and cover may be provided. Further, the storage container may also be formed in a conventional drawer-like configuration so as to be slideably stacked in a cabinet when not in use.

The storage container 12 further includes a pair of spaced guide rods 24 and 26 which extend substantially horizontally between the front and rear portions 14 and 16, respectively, of the container 12 and which are disposed above the bottom 22 of the container 12. The guide rods 24 and 26 may be of any convenient shape, such as circular or rectangular, so as to facilitate the sliding movement of the file envelope 10 therealong, as described in greater detail hereafter.

The file envelope 10, is suitably formed to removably receive a plurality of cards or records and is dimensioned so as to suit a wide variety of applications. Preferably, the file envelope 10 is formed of heavy paper so as to provide a rigid enclosure which surrounds and protects the cards or records inserted therein. Although paper is preferred, any suitable material may be utilized to form the file envelope 10 of this invention.

The file envelope 10 is formed by any conventional means, such as by blanking or cutting a suitably dimensioned blank from sheet material. The blank is then folded to form front and rear wall portions 28 and 30, respectively, as shown more clearly in FIG. 2. The front and rear wall portions 28 and 30 are substantially upstanding and include top, bottom and side portions or edges 32,34 and 36, respectively.

Although the file envelope 10 has been described as being formed of a folded blank, the bottom portion of the file envelope 10 may also be formed by suitably attaching or joining together separate front and rear wall portions 28 and 30 to form a closed surface which supports the plurality of cards or records shown generally by reference number 38 in FIG. 2 therein.

The file envelope 10 further includes means 40 for securing or fixing the side edges or portions 36 of the front and rear wall portions 28 and 30 together to form a continuous enclosure having an open top end for receiving a plurality of rectangular cards 38. Preferably, the securing means 40 comprises adhesive tape 41 which is disposed around the side portions 36 of the front and rear wall portions 28 and 30 so as to secure the front and rear wall portions 28 and 30 together at the side edges 36 thereof. Although adhesive tape has been described and illustrated, it will be noted that any conventional attaching or fastening means may be utilized to join the side edges of the file envelope 10 together to form a continuous enclosure for the business records.

As noted above, the file envelope 10 is suited for use in removably receiving a plurality of rectangular records 38 therein. More specifically the file envelope 10 is dimensioned so as to receive a plurality of rectangular cards 38 wherein the rectangular cards 38 consist of standard sized computer cards or magnetic cards utilized with word processing equipment. Thus, the cards 38 have a rectangular configuration and are approximately three inches by seven inches in size. It will also be noted that the dimensions of the storage container 12 may be altered so as to adapt the file envelope 10 of this invention to receive a wide variety of different configured papers or cards. Thus, the dimensions of the file envelope 10 and the storage container 12 may be chosen to provide storage for the substantially square magnetic floppy discs, as well as conventional papers and letters.

As shown in FIG. 2, the file envelope 10 includes a pair of opposed apertures 42 and 44 which are formed adjacent the side edges 36 of the file envelope 10 in both the front and rear wall portions 28 and 30. The apertures 42, which preferably comprise a horizontally-extending slot, have an open end at the side edge 36 of the file envelope 10. The height of the apertures 42 and 44 is chosen so as to permit the bottom portion 34 of the file envelope 10 to be in proximity on the bottom 22 of the storage container 12 when the file envelope 10 is inserted in the container 12 and the apertures 42 and 44 engage the guide rods 24 and 26 respectively. Alternately, a second pair of spaced rods 18 and 20 may be provided adjacent the bottom 22 of the container 12, as shown in FIG. 1, to minimize wear and abrasion on the bottom of the file envelopes 10 caused by frequent sliding movement of the file envelopes 10 along the guide rods 24 and 26.

As noted above, the apertures 42 and 44 function to permit the file envelope 10 to be removably inserted on the guide rods 24 and 26 within the container 12, such that the file envelope 10 is placed upon and slidingly supported on the guide rods 24 and 26 thereby facilitating easy insertion and removal of the file envelope 10 in the container 12.

Figure 3:
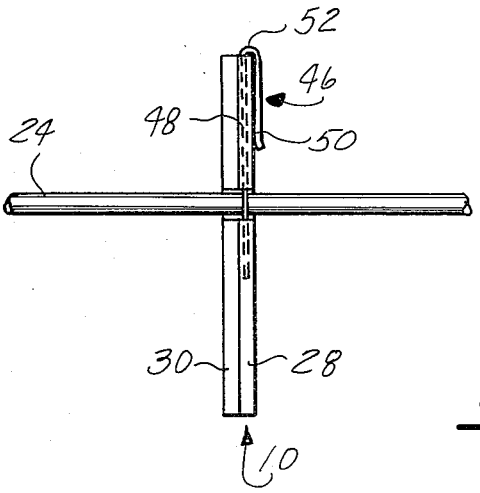
FIG. 3 is a side view of the securing means utilized to maintain the file envelope on the guide rods in the storage container as shown in FIG. 1.

As shown in FIG. 1, and in greater detail in FIG. 3, the file envelope 10 of this invention further includes means, denoted generally by reference number 46, for releasably securing the file envelope 10 on the guide rods 24 and 26. Preferably the securing means 46 is inserted along the side portions or edges 36 of the file envelope 10 after the envelope 10 has been inserted within the container 12 and the apertures 42 and 44 engage the guide rods 24 and 26. The securing means 46 is inserted between the guide rods 24 and 26 in the apertures 42 and 44, as shown in FIG. 1, and the side edge 36 of the file envelope 10 so as to secure the file envelope 10 on the guide rods 24 and 26 and, at the same time, allow sliding movement of the file envelope 10 along the guide rods 24 and 26.

Preferably, the securing means 46 comprises a substantially U-shaped member having first and second depending legs 48 and 50 respectively, which are joined together at a common end 52. The legs 48 and 50 may be of the same length; however, preferably one of the legs 48 and 50 is smaller than the other to facilitate the insertion of the securing means 46 over envelope 10. The securing means 46 is preferably formed of a resilient material, such as spring steel, so as to exert a spring or a clamping force on the file envelope 10 and thereby retain the same on the guide rods 24 and 26.

In use, the securing means 46 is inserted between the guide rod 24 or 26 and the side edge 36 of the file envelope 10 such that the first and second depending legs 48 and 50 are disposed over one of the front or rear walls 28 and 30 of the file envelope 10, such as the rear wall 30, as shown in FIG. 3. In this manner, the securing means 46 secures the file envelope 10 on the guide rods 24 and 26 and is easily removable therefrom to permit the complete removal of the file envelope 10 from the file drawer 12.

In summary, there has been disclosed herein a new and improved storage apparatus for removably receiving business records. The storage apparatus comprises a storage container having a pair of spaced, horizontally extending guide rods extending between front and rear wall portions thereof. The storage apparatus also includes a file envelope having a pair of opposed apertures located on the side edges thereof which engage the guide rods in the storage container and enable the file envelope to be placed on the guide rods and supported thereby for sliding movement therealong.

Securing means are provided to hold the file envelope on the guide rods. The securing means comprises removable members which are disposed over the front or rear wall of the file envelope 10 so as to engage the envelope 10 between the guide rods and the side edges of the envelope 10. In this manner, the file envelope may be quickly and easily inserted or removed from the storage container. The file envelope of this invention maintains a plurality of planar business records inserted therein in a predetermined order and in a vertical upright position thereby preventing damage to the records and facilitating a more compact storage of the records.

What is claimed is

1. A storage apparatus for removably receiving planar members comprising:

a container having front and rear wall portions and a pair of spaced rods extending between said front and rear portions; and a file envelope adapted to be disposed within said container and adapted to removably receive said planar members, said file envelope comprising:

upstanding front and rear wall portions each having top, bottom and opposed side portions;

a pair of opposed apertures in the form of substantially horizontally extending slots disposed in said side portions of said front and rear walls of said file envelope, each of said slots having an open end to enable said file envelope to be placed on said rods in said container so as to slidingly support said file envelope on said rods; and first and second removable means respectively associated with opposed side portions of said file envelope for securing said file envelope on said rods, said first and second securing means adapted to close said open end of said slots in said file envelope to secure said rods within said slots.

2. The storage apparatus of claim 1 wherein the front and rear wall portions of said file envelope are joined together at the side and bottom edges thereof to form an enclosure with an open top.

3. The storage apparatus of claim 1 further including means for joining the side portions of the front and rear wall portions of said file envelope together to form a continuous enclosure having an open top.

4. A storage apparatus for removably receiving planar members comprising:

a container having front and rear wall portions and a pair of spaced rods extending between said front and rear wall portions; and a file envelope adapted to be disposed within said container and adapted to removably receive said planar members, said file envelope comprising:

upstanding front and rear wall portions each having top, bottom and opposed side portions;

a pair of opposed apertures disposed in said side portions of said front and rear walls of said file envelope, each of said apertures having an open end to enable said file envelope to be placed on and supported by said rods in said file drawer; and means for removably securing said file envelope on said rods, said securing means comprising:

a substantially U-shaped member having first and second depending legs;

said first and second legs adapted to be disposed over one of the front and rear wall portions of said file envelope adjacent to the side portion thereof such that one of said first and second legs is disposed between said front and rear wall portions to releasably secure said file envelope on the rods in the file drawer.

5. A file envelope adapted to be removably received in a storage container having front and rear portions and a pair of spaced rods extending therebetween, said file envelope comprising:

upstanding front and rear wall portions, each having top, bottom and opposed side portions;

a pair of opposed apertures in the form of substantially horizontally extending slots disposed in said side portions of said front and rear walls of said file envelope, each of said slots having an open end to enable said file envelope to be placed on said rods in said storage container so as to slidingly support said file envelope on said rods; and first and second removable means for securing said file envelope on said rods, said first and second securing means adapted to close said open end of said slots in said file envelope to secure said rods within said slots.

6. A file envelope adapted to be removably received in a storage container having front and rear portions and a pair of spaced rods extending therebetween, said file envelope comprising:

upstanding front and rear wall portions, each having top, bottom and opposed side portions;

a pair of opposed apertures disposed in said side portions of said front and rear walls of said file envelope each of said apertures having an open end to enable said file envelope to be placed on and supported by said rods in said storage container; and means for removably securing said file envelope on said rods, said securing means comprising:

a substantially U-shaped member having first and second depending legs;

said first and second legs adapted to be disposed over one of the front and rear wall portions of said file envelope adjacent to the side portion thereof such that one of said first and second legs is disposed between said front and rear wall portions to releasably secure said file envelope on the rods in said storage container.

7. A file envelope adapted to be removably disposed in a storage container having front and rear portions and a pair of spaced rods extending between said front and rear portions, said file envelope comprising:

upstanding front and rear walls, each having top, bottom and opposed side portions, said respective side and bottom portions of said front and rear walls being joined together to form a continuous enclosure having an open top end adapted to receive record materials therein;

a pair of opposed apertures located on opposite side portions of said file envelope and extending substantially horizontally inward from said side portions and having an open end to enable said file envelope to be placed on and slidingly supported by said rods in said storage container; and means for removably securing said file envelope on said rods, said securing means comprising a substantially U-shaped member having first and second depending legs, said first and second legs adapted to be disposed over one of said front and rear wall portions of said file envelope such that one of said first and second legs is disposed between said front and rear wall portions, said securing means adapted to be removably disposed on said file envelope between said side portions thereof and said rod disposed in said aperture of said file envelope to secure said envelope on said rod and to enable sliding movement therealong.

* * * * *